United States Patent [19]

Hayashi et al.

[11] 3,959,115

[45] May 25, 1976

[54] PRODUCTION OF PETROLEUM COKES

[75] Inventors: Kiyoshige Hayashi, Tokyo; Mikio Nakaniwa, Ichihara; Minoru Yamamoto, Ichihara; Kazuo Ozaki, Ichihara; Arimasa Baba, Tokyo, all of Japan

[73] Assignees: Maruzen Petrochemical Co., Ltd.; The Chiba Carbon Research Corporation, both of Tokyo, Japan

[22] Filed: Nov. 4, 1974

[21] Appl. No.: 520,855

Related U.S. Application Data

[63] Continuation-in-part of Ser. No. 334,273, Feb. 21, 1973, abandoned.

[30] Foreign Application Priority Data

Mar. 1, 1972 Japan ..... 47-20625

[52] U.S. Cl. ..... 208/53; 208/131

[51] Int. Cl.[2] ..... C10G 9/14

[58] Field of Search ..... 208/53, 131

[56] References Cited

UNITED STATES PATENTS

| | | | |
|---|---|---|---|
| 3,472,761 | 10/1969 | Cameron | 208/131 |
| 3,547,804 | 12/1970 | Noguchi et al. | 208/131 |
| 3,617,480 | 11/1971 | Keel | 208/53 |
| 3,769,200 | 10/1973 | Folkins | 208/53 |

*Primary Examiner*—Herbert Levine

*Attorney, Agent, or Firm*—Larson, Taylor and Hinds

[57] ABSTRACT

Any kind of virgin, low-sulfur crude oil is directly treated in a two-stage delayed coking process for yielding non-crystalline coke in the first stage and high-crystalline coke in the second stage, which process comprises preheating the crude oil in a tube heater tc 460° – 520°C under 5–20 kg/cm²G, maintaining the oil therein at that temperature for 30 – 500 seconds to allow the oil to be heat-soaked, subjecting the oil to first delayed coking under relatively mild conditions and subjecting the uncoked heavy residual oil to second delayed coking under relatively severe conditions.

3 Claims, No Drawings

PRODUCTION OF PETROLEUM COKES

This application is a continuation in part of Ser. No. 334,273, filed Feb. 21, 1973 and now abandoned.

This invention relates to a process for producing two types of petroleum coke, non-crystalline and high-crystalline, from a virgin crude oil having a low sulfur content by a two-stage delayed coking, which process is well applicable to any kind of low-sulfur, virgin petroleum crude oils including those from which a premium grade coke could never been obtained in the prior art.

In the specification and claims, by "non-crystalline coke" is meant a petroleum coke of a non-crystalline texture, namely being amorphous in appearance and non-graphitizable in nature to such extent as having never been obtainable from a petroleum origin, and by "high-crystalline coke" is meant a petroleum coke of a highly crystalline texture, namely being highly graphitizable in nature to a greater extent than the so-called premium grade coke. Typical properties of non-crystalline and high-crystalline cokes will be shown hereinafter in Table 1 in comparison with those of the so-called regular grade and premium grade cokes.

It is known that the so-called premium grade petroleum coke which has a needle-like structure may be produced from distillation or cracked residuum of certain limited petroleum crude oils having a low-sulfur content, such as Minas crude oil coming from Indonesia, by the so-called delayed coking process when operated under well-controlled conditions with respect to many process variables, namely, coking temperature and pressure, proportion of thermally cracked residuum admixed with distillation residuum and others. In the prior art processes for delayed coking, however, it was essential for the successful production of premium grade coke to use distillation residuum derived from certain specific kinds of low-sulfur crude oils and to blend said residuum with a heavy oil or tar or highly aromatized nature resulting from a thermal treatment.

We have practically experienced that distillation residuum of Minas crude oil suits the production of a premium grade coke in the sense as above-mentioned, but that of Djatibarang crude oil coming from Indonesia does not. This is shown concretely in the following runs.

In the first run, Minas virgin crude oil having a specific gravity of 0.850 (15/4°C) and a sulfur content of 0.07% by weight was fractionated at atmospheric pressure into 13.8% by weight gasoline, 9.8% kerosene, 6.2% light gas oil and a residual oil which was then subjected to vacuum distillation to remove 34.3% heavy gas oil fraction rich in paraffin wax. Thus, a vacuum residue having a specific gravity of 0.920 (15/4°C), sulfur content of 0.20% and asphaltene content of 14.5% was obtained in the yield of 34.3% based on the weight of the starting crude oil. Eighty (80) parts by weight of the vacuum residue were blended with 20 parts by weight of a thermally cracked heavy oil derived as by-product from a thermal cracking of naphtha for the production of ethylene and the blend was subjected to delayed coking at a temperature of 430° – 450°C under a pressure of 9 – 12 kg/cm$^2$G for 36 hours. The yield of coke was 12 – 16% based on the weight of the vacuum residue used.

The green coke thus obtained was calcined at 1450°C and characterized by a degree of graphitization as a measure of graphitizability from [002] diffraction pattern by X-ray analysis.

The degree of graphitization, $h/w$, is calculated by the following formula:

$h/w$ = height of [002] peak width at half intensity

The diffraction pattern was measured under the following conditions:

| | |
|---|---|
| Target: | CuKα (Filter: Nickel) |
| Voltage and Current: | 30 KVP; 20mA |
| Current Voltage: | Proportional Counter, 1450 V |
| Count Full Scale: | 10000 c/s to 20000 c/s |
| Time Constant: | 2 sec. |
| Slit: | Divergence 1°; Receiving Slit: 0.15 mm |
| Scanning Speed: | 1°/min. |
| Chart Scanning Speed: | 2 cm/min. |

The sample for the measurement of X-ray diffraction was prepared by the following procedures: The calcined coke was pulverized and sieved out 350 mesh plus. A certain amount of this coke flour was put into an aluminium mount (15 mm in length × 20 mm in width × 1.5 mm in thickness), pressed under a given pressure and then used for the measurement.

The coefficient of thermal expansion of a graphite artefact prepared from the coke was also measured. The test piece for the measurement of coefficient of thermal expansion was prepared by the following procedure:

The calcined green coke was pulverized into particle size fractions of 35 – 65 mesh and 100 mesh plus. The coke grist used in making the test artefact contained 40 parts of the former fraction and 60 parts of the latter fraction. Seventy (70) parts of the coke composite and 30 parts of coal tar pitch were well mixed and the mixture was extruded through a hydraulic extruder to form a green extruded rod of 20 mm in diameter. The green extrudate was packed in carbon powder and slowly baked to form a baked artefact. The baking schedule consisted of increasing the temperature in linear fashion to 1000°C over a period of 8 hours and keeping that temperature for 3 hours. Graphitization of the artefact was carried out in a graphite tube resistance furnace at 2600°C for 1 hour.

The degree of graphitization $h/w$ of the calcined coke obtained in the first run above was 4.9 – 5.1 and the metal contents of the same were 6 ppm (by weight) Fe, 6 ppm Cu, 3 ppm Ni and 4 ppm V. The coefficient of thermal expansion (CTE) of graphite artefact of the coke of the same run was $0.90 \times 10^{-6}$/°C (direction parallel to the extrusion, over 100° to 400°C). The results showed that the coke obtained in the first run is of high crystalline texture suitable for the preparation of graphite electrodes.

In another run, Djatibarang virgin crude oil having a specific gravity (15/4°C) of 0,883, sulfur content of 0.13% by weight and asphaltene content of 8.9% by weight was fractionated at atmospheric pressure into 9.7% by weight gasoline, 7.4% kerosene, 5.2% light gas oil and a residual oil which was then subjected to vacuum distillation to remove 19.0% heavy gas oil fraction rich in paraffin wax, leaving a vacuum residue in the yield of 56.5% based on the weight of the original crude oil, which has a specific gravity of 0.915 (15/4°C), sulfur content of 0.20% and asphaltene content of 19.1%. Eighty (80) parts by weight of the vacuum residue were blended with 20 parts by weight of a thermally cracked heavy oil derived as by-product from a thermal cracking of naphtha for the production of ethylene and the blend was subjected to delayed coking at a temperature of 430° – 450°C under a pressure of 9 – 15 kg/cm²G for 36 hours. The yield of coke was 18 – 22% based on the weight of the vacuum residue used. The coke, after calcining, has a value of $h/w$ of 2.6 – 3.4 and metal contents of 8 ppm Fe, 0.8 ppm Cu, trace Ni and 0.2 ppm V and CTE of graphite artefact of 3.7 – $4.9 \times 10^{-6}$/°C when measured as in the first run, showing that the coke is distinctly inferior in quality to commercial regular grade coke.

We have further tried for Djatibarang crude oil to apply various coking processes as those undermentioned, but in all cases failed in obtaining a premium grade needlelike coke: a process in which Djatibarang crude oil or a distillation or cracked residue thereof is heat-treated at 350° –. 500°C and then subjected to delayed coking; a process in which the same starting material as above is mixed with a thermal tar obtained by thermal cracking of a gas oil fraction derived from a delayed coking and the mixture is subjected to delayed coking; a process in which the same starting material as above is treated by extraction or distillation to remove a part of the material and then subjected to delayed coking; a process in which the same starting material as above is heated in the presence or absence of a catalyst, then subjected to distillation, extraction, filtration, decantation or centrifugal separation to remove a part of the material and subsequently subjected to delayed coking; and a process in which the same starting material as above is treated by a known two-stage delayed coking process.

In view of the fact that the results of our experiments, particularly those of the two runs above-detailed, show that vacuum residue of Minas crude oil gave a high-crystalline coke, whereas vacuum resudue of Djatibarang crude oil gave a very low grade coke in spite of the substantial similarity in their sulfur, asphaltene and metal contents and in the proportion of thermal tar blended therewith, it is suggested that the latter material cointains a substantial amount of substances capable of preventing the growth of coke crystals (hereinafter referred to as non-cyrstalline substances).

It is apparant that in order to obtain a high-crystalline coke from a starting material containing a substantial amount of non-crystalline substances such as Djatibarang crude oil and its residue, complete and efficient removal of the non-crystalline substances is necessary, but no economical success has been achieved as yet for this purpose. Thus, a heat-treatment of the starting material or recycling of a thermal tar was ineffective for the removal of non-crystalline substances. Incorporation of an oil or tar containing no such non-crystalline substances into the starting material would really result in lowering the concentration of non-crystalline substances, but no appreciable improvement in the crystallinity of coke was obtained. For example, the process proposed by R.C. Hackley in U.S. Pat. No. 2,922,755 wherein a petroleum-derived charge stock comprising a highly aromatic thermal tar and about 10 to 30% by weight of a virgin reduced crude is subjected to coking conditions of temperature and pressure, could not be applied successfully to starting materials containing a substantial amount of non-crystalline substances for the purpose of producing a premium grade coke.

Previous treatment, such as extraction and distillation, of starting materials containing a substantial amount of non-crystalline substances also gave no substantial improvement in the crystallinity of coke.

A process wherein a heavy petroleum residuum is heat-treated in the presence or absence of a catalyst, then a part of the residuum thus heat-treated is removed by filtration, distillation, centrifugation, extraction and the like and thereafter the residuum remained is subjected to delayed coking, typically one proposed by F.L. Shea in U.S. Pat. No. 2,775,549, was effective to a certain extent, but still insufficient for the complete removal of non-crystalline substances, thus resulting in the formation of not a premium grade but a regular grade coke at most if the starting material used contains a substantial amount of non-crystalline substances.

A variant of the last-mentioned process proposed by H. E. Keel in U.S. Pat. No. 3,617,480 which is characterized in that the heat-treatment of the starting petroleum residuum is effected by a delayed coking operation was also still insufficient, when applied to a petroleum residuum containing a substantial amount of non-crystalline substances, for the selective removal of the non-crystalline substances in the said first coking stage, possibly duje to the coprecipitation of crystalline substances with non-crystalline ones in the form of a coke occurring in the first coking stage and also due to the contamination, with non-crystalline substances, of uncoked product in that stage which is to be coked in the second stage to form a premium grade coke, thus inevitably bringing the lowering in both the yield and quality of the coke obtained in the second coking stage. Similar disadvantages were more or less unavoidable in other two-stage delayed coking processes as for example proposed by D. F. Cameron in U.S. Pat. No. 3,472,761 and by H. O. Folkins in U.S. Pat. No. 3,769,200 when starting materials used contain a substantial amount of non-crystalline substances.

As outlined above, it was very difficult to achieve economically the complete and efficient removal of non-crystalline substances from materials from which a premium grade or more highly crystalline coke should be produced, and as far as we know there has been established no process suited for a commercial large-scale production of a premium grade or high-crystalline coke starting from a petroleum feedstock containing a substantial amount of non-crystalline substances.

We have made many studies on the removal of non-crystalline substances from petroleum feedstocks for the production of premium grade or high-crystalline coke and now established a new process for the production of a high-crystalline coke simultaneous with the production of a non-crystalline coke in efficient and economical manner starting from not a petroleum residuum but a virgin crude oil having a low sulfur content by the combination of a previous heat-treatment under specific conditions with a two-stage delayed coking in which a non-crystalline coke is produced in the first stage operated under certain mild conditions and a high-crystalline coke is produced in the second stage. Our success is believed to be the result of the selective and complete removal of non-crystalline substances contained in the starting virgin crude oil as non-crystalline coke in the first coking stage by the combination of the specific previous heat-treatment with the specific first delayed coking.

According to the present invention, therefore, we provide a process for producing both non-crystalline and high-crystalline petroleum cokes directly from a virgin crude oil having a sulfur content of lower than 0.4% by weight by a two-stage delayed coking which comprises preheating the virgin crude oil in a tube heater to a temperature of 460° – 520°C under a pressure of 5 – 20 Kg/cm²G, maintaining the oil in the tube heater at that temperature for 30 – 500 seconds, preferably for 200 – 500 seconds, to effect cracking and heat-soaking thereof, introducing the oil thus heat-treated by flashing into a first coking drum, where the oil is subjected to a first delayed coking at a temperature of 410° – 430°C under a pressure of 2 – 10 Kg/cm²G for a residence time of 3 – 5 hours to produce a non-crystalline coke, removing from the uncoked product of the first coking stage cracked gases and light petroleum fractions including gasoline, kerosene and gas oil to provide a heavy residue, preheating said heavy residue of the uncoked product to a temperature required for a second coking stage, introducing the preheated heavy residue into a second coking drum, where it is subjected to a second delayed coking at a temperature of 430° – 460°C under a pressure of 4 – 20 Kg/cm²G to produce a high-crystalline coke having a coefficient of thermal expansion of less than $1.0 \times 10^{-6}$/°C over 100° – 400°C when measured in the form of a graphite artefact thereof.

By the term "a residence time" used above with respect to the first coking stage of the present invention, is meant the quotient given by dividing the volume of the first coking drum by the volumetric flow rate of feedstock.

The non-crystalline coke obtained by the first delayed coking of the process according to the present invention has an amorphous texture as high as charcoal and activated carbon in contrast to petrolium cokes of the prior art which are more or less crystalline in their texture. Such non-crystalline coke is suitable for the production of various carbonaceous products including activated carbon, adsorbent and catalyst in the form of a carbon-metal complex. These carbonaceous products are expected to have increasing large demands for use in pollution problems to be solved throughout the world, particularly in view of the complete removal or destruction of various air-pollutants and water-contaminants occurring in conjunction with the activities of factories, motor cars and cities.

On the contrary, all the attempts starting from distillation and cracked residue of low-sulfur crude oils containing a substantial amount of non-crystalline substances instead of the corresponding virgin crude oils in the process according to the present invention have ended in failure because the deposition of a considerable amount of coke formed on the inner wall of the tube heater causes blocking of the tube heater which in turn makes it impossible to effect the heat-soaking under sufficient conditions of temperature and time and to effect the efficient and complete removal of the non-crystalline substances.

It is believed that the complete and efficient removal of the non-crystalline substances from the starting virgin crude oil achieved by the process according to the present invention is attributable to the fact that light fractions, both existing in the crude oil and resulting from mild cracking of the same during the preheat treatment, and paraffins with relatively long chain, e.g. those containing 15 – 20 carbon atoms, resulting from mild cracking of long-chain paraffins contained in the crude oil during the pre-heat treatment, cause turbulent flow during their passing through the tube heater, whereby the blocking of the tube heater due to the deposition of coke on the inner wall of the tube and due to rapid growth of carbon brought about by the superheating of the tube wall can be very effectively prevented and also to the fact that the presence of the said light fractions in the crude oil thus pre-heat treated and introduced into the first coking drum can remarkably promote the separation of non-crystalline substances by selective conversion thereof into non-crystalline coke in the first coking drum while avoiding the deposition of crystalline coke at this stage. As a result, the uncoked oil fraction leaving the first coking drum has had effectively removed therefrom non-crystalline substances and is therefore more suited as feedstock for the production of a high-quality coke. Thus, a heavy residue derived from a distillation of the uncoked oil fraction leaving the first coking drum gives, when subjected to the second delayed coking specified in the process of the present invention, a high-crystalline coke which is of higher degree of crystallinity than that of the so-called premium grade coke, with a commercially acceptable yield.

Such a high-crystalline coke as produced by the process according to the present invention is most suitable for the preparation of synthetic graphite electrodes. In the past, the quality of premium grade needle coke of the prior art was substantially satisfactory for the purpose of making graphite electrodes. At present, however, with the rapid progress of electric arc furnaces together with the trend toward increasing power loads in these furnaces, the synthetic graphite electrodes to be used therefor are requiring the supply of increasing amount of high-crystalline coke of higher quality than the premium grade one. Moreover, with the progress of steel-making industries using iron pellets, a great demand of such a high-crystalline coke is also expected in future for making high-power graphite electrodes to be used therefor.

It is well-known that the quality or performance of synthetic graphite electrodes depends largely upon the graphitizability of cokes from which the electrodes are made. Thus, the higher the crystallinity of coke, the higher the graphitizability thereof and there are several factors, such as coefficient of thermal expansion (CTE), degree of graphitization ($h/w$), size of crystallites (LcLa), real density and specific resistance, as measures of evaluating the quality of cokes. Among others, the most important criterion responsible to the graphitizability of coke is, we believe, the value of CTE.

Typical properties of various grades of coke are shown in Table 1.

Table 1

| | Coefficient of[1] thermal expansion (CTE) over 100°–400°C ($\times 10^{-6}$/°C) | Degree of[2] graphitization h/w | Real[3] density at 2500°C |
|---|---|---|---|
| Non-crystalline coke | Above 5.0 | Below 2.0 | Below 2.00 |

Table 1-continued

| | Coefficient of[1] thermal expansion (CTE) over 100°–400°C ($\times 10^{-6}$/°C) | Degree of[2] graphitization h/w | Real[3] density at 2500°C |
|---|---|---|---|
| Regular grade coke (for general purposes) | 1.8 – 3.0 | 4.1 – 4.4 | Around 2.10 |
| Regular grade coke (for electrodes) | 1.2 – 1.8 | 4.4– 4.8 | Above 2.15 |
| Premium grade coke | 1.0 – 1.2 | 4.5 – 5.0 | Above 2.15 |
| High-crystalline coke | Below 1.0 | Around 5.0 | Above 2.15 |

[1]measured on a graphite artefact
[2]measured on a calcined coke
[3]measured on a graphitized coke The non-crystalline coke corresponds to "hard carbon" so-called, such as charcoal and activated carbon and as far as we know such a type of coke has not been obtained from a petroleum origin. Most of petroleum cokes and pitch cokes which are generally called as "soft carbon" fall within the class of regular grade ones and the premium grade coke is rather a special class for petroleum cokes and the high-crystalline coke is much more rare, as hereinbefore mentioned. This will evidence the process of the present invention to be quite unique and advantageous over the prior art processes in such point that it gives both non-crystalline and high-crystalline cokes simultaneously in economical and efficient way, details of which will be illustrated later in Examples.

The sulfur content of the starting virgin crude oil is important if the high-crystalline coke obtained is to be used for making graphite electrodes in view of a detrimental effect of sulfur to the mechanical strength of the electrodes. Thus, the sulfur content of the virgin crude oil to be used in the present invention should be lower than 0.4%, preferably lower than 0.25% by weight.

We have further found that in the first coking stage according to the process of this invention which is conducted under relatively mild conditions, the wax content of the uncoked product is remarkably increased probably due to mild pyrolysis of relatively high boiling components of the virgin crude oill occurring during the pre-heat treatment and the first delayed coking.

Therefore, according to a preferreed embodiment of this invention, there is provided a modification that after the uncoked product of the first coking stage is subjected to degasification and atmospheric distillation to remove cracked gases and light petroleum fractions including gasoline, kerosene and light gas oil in a usual manner, the residual oil is further subjected to vacuum distillation to remove a heavy gas oil fraction rich in paraffin wax, and thereafter the vacuum residue, which is optionally diluted with a light gas oil fraction, is subjected to the second delayed coking. This modification provides the production of useful vacuum distillates with high was content in an improved yield in addition to the production of both non-crystalline and high-crystalline cokes. The waxy distillates has been found to have a higher paraffin wax content than that of those obtained from the virgin crude oil by atmospheric distillation followed by vacuum distillation in usual manner.

As stated above, the feedstock subjected to the second delayed coking according to the process of this invention is fundamentally a heavy residue obtained by subjecting a virgin, low-sulfur crude oil to the specific pre-heat treatment and then to the first delayed coking operated under certain mild conditions followed by removing from the resulting uncoked product cracked gases and light petroleum fractions such as gasoline, kerosene and light gas oil and optionally by removing further a waxy fraction by vacuum distillation. It will readily be understood, however, that certain other materials, such as thermal tars, may additionally be used, the use of which is known in the art as additional feed for conventional single-stage delayed coking of distillation residues. Preferred examples of such additional feed may include heavy residue derived as by-product from high-temperature cracking of naphtha for the production of ethylene, thermal tar derived from the cracked gas oil in the uncoked products of the first and second coking steps of this invention by a further thermal cracking and subsequent distillation, and the like.

The following Examples further illustrate, but not limit, this invention, in which percentages are by weight unless otherwise stated.

EXAMPLE 1

Djatibarang virgin crude oil having specific gravity of 0.880 (15/4°C), sulfur content of 0.11% and asphaltene content of 8.9% was used as feedstock for this run. The crude oil was preheated in a tube heater under a pressure of 15 kg/cm²G to 480°C and maintained therein at this temperature for 360 seconds to allow the feedstock to be heat-soaked and then continuously introduced by flashing into a first coking drum, wherein a first delayed coking was effected at 415°C and 2 kg/cm²G for a residence time of 4.3 hours to produce a non-crystalline coke. The uncoked, but cracked oil obtained therein was distilled at atmospheric pressure to remove cracked gases (5.4%), a gasoline fraction (12.3%) and a kerosene-gas oil fraction (25.0%). The bottom residue of the distillation having specific gravity (15/4°C) of 0.901, sulfur content of 0.11% and asphaltene content of 0.55% was then preheated and introduced into a second coking drum, wherein a second delayed coking was effected at 435° C and 9 kg/cm²G for 28 hours to produce a high-crystalline coke.

The coking drums of the first and second stages, after the delayed coking was completed, were purged with superheated steam at about 600°C to eliminate oils remained therein.

The petroleum coke obtained from the first coking stage was substantially amorphous and had *h/w* of 1.0 and coefficient of thermal expansion (CTE) (100° – 400°C; directed parallel to the extrusion) of 6.7 × $10^{-6}$/°C. The yield of the coke was 6.0% based on the crude oil fed.

The petroleum coke obtained from the second coking stage in the yield of 10% based on the crude oil showed the following properties:

| | |
|---|---|
| Real density, g/cc | 2.15 |
| Apparent density in water(8–12 mesh),g/cc | 2.102 |
| Crushing strength, % | 58.5 |
| Coefficient of thermal expansion (100–400°C), × $10^{-6}$/°C | |
| Direction parallel to the extrusion | 0.98 |
| Direction parallel to the thickness | 3.33 |
| Degree of graphitization h/w | 5.0 |
| Specific resistance, × $10^{-5}$ Ω –cm | 69 |

The real density, apparent density, crushing strength and degree of graphitization *h/w* are of calcined coke and the coefficient of thermal expansion and specific resistance are of graphite artefact.

The crushing strength was determined by the following procedure:

About 30g of calcined coke grist of 5 to 12 mesh size were put into a cylindrical mold made of stainless steel, 30 mm I.D. by 100 mm long. After setting a cylindrical piston heat to contact with the top surface of the coke grist, a load up to a pressure of 100 kg/cm²G was applied thereto in 30 seconds and the load was kept for further 30 seconds. The coke grist was then taken out of mold and sieved out 12 mesh minus. The remaining coke grist was weighed. The ratio of the remaining coke grist to the original one is expressed as crushing strength in per cent by weight.

EXAMPLE 2 (COMPARISON)

This Example was given only by way of comparison with the experiments given in Example 1.

A 340+°C reduced crude derived from the Djatibarang virgin crude oil used in Example 1 was used in this Example instead of the virgin crude oil. The 340+°C residual oil which had specific gravity (15/4°C) of 0.955, sulfur content of 0.18% and asphaltene content of 11.0% was preheated in a tube heater under a pressure of 18 kg/cm²G to 480°C and maintained therein at this temperature for 300 seconds and then introduced by flashing into a first coking drum, wherein a first delayed coking was effected at 415°C and 2 kg/cm²G. After the lapse of only 1.5 hours from the start of introduction of the pre-heat treated oil into the first coking drum, the blocking of the tube heater occurred and the operation had to be stopped forthwith.

In another run, the same 340+°C reduced crude as above was preheated to 480°C in the same way as that in the above run and then immediately introduced into the first coking drum without being heat-soaked. The two-stage delayed coking operation same as that used in Example 1 was adopted for this run except that the residence time in the first coking drum was 5.0 hours instead of 4.3 hours. Thus, the coke obtained in the first coking drum in the yield of 7.5% had *h/w* of 2.2 and CTE of 4.7 × $10^{-6}$/°C and the coke obtained in the second coking drum in the yield of 8.5% had *h/w* of 4.6 and CTE of 1.20 × $10^{-6}$/°C.

For convenience sake, the operating conditions used and the rsults obtained in respective runs carried out in Examples 1 and 2 are summarized in Table 2.

Table 2

| Feedstock | Example 1 Run 1 Djatibarang virgin crude oil | | Example 1 Run 2 Djatibarang virgin crude oil | | Example 2 Run 1 Djatibarang 340+°C residue | Example 2 Run 2 Djatibarang 340+°C residue | |
|---|---|---|---|---|---|---|---|
| Heat-soaking time (seconds) | 360 | | 0 | | 300 | 0 | |
| Preheating pressure (kg/cm²G) | 15 | | 15 | | 18 | 18 | |
| Coking stage | 1st | 2nd | 1st | 2nd | Due to the blocking of the tube heater, the operaton had to be stopped after only 1.5 hours. | 1st | 2nd |
| Residence time in the first coking drum | 4.0 | — | 4.3 | — | | 5.0 | — |
| Yield of coke % | 6.0 | 10.0 | 8.0 | 9.8 | | 7.5 | 8.5 |
| CTE (100–400°C) × $10^{-6}$/°C | 6.7 | 0.98 | 5.2 | 1.10 | | 4.7 | 1.20 |
| h/w | 1.0 | 5.0 | 2.0 | 4.7 | | 2.2 | 4.6 |

Outlet temperature of the tube heater: 480°C
1st coking stage: temperature 415°C; pressure 2 kg/cm²G
2nd coking stage: temperature 435°C; pressure 9 kg/cm²G These results clearly show the excellence in mechanical strength and graphitizability of the coke obtained in the second coking drum which was evaluated as high-crystalline coke.

By way of comparison, the same procedure as above was repeated except that the virgin crude oil having been preheated in a tube heater to 480°C under a pressure of 15 kg/cm²G was immediately introduced into the first coking drum without being heat-soaked. In this run, the coke obtained in the first coking drum in the yield of 8.0% based on the crude oil had *h/w* of 2.0 and CTE of 5.2 × $10^{-6}$/°C and the coke obtained in the second coking drum in the yield of 9.8% based on the crude oil had *h/w* of 4.7 and CTE of 1.10 × $10^{-6}$/°C, the latter coke being evaluated as premium grade coke and not as high-crystalline one.

In Table 2, the first run, i.e. Example 1, Run 1, is the only example of the process according to the present invention and the other three runs are of comparison purposes. The comparison between Run 1 and Run 2 in Example 1 shows the superiority of the former in efficiency of the removal of non-crystalline substances in the first coking stage, which is undoubtedly attributable to the heat-soaking effected in the pre-heat treatment. The comparison of Run 1 in Example 1 with Runs 1 and 2 in Example 2 clearly demonstrates the unexpected superiority and advantage of the former being based on the use as feedstock of a virgin, low-sulfur crude oil.

EXAMPLE 3

This Example is provided to show the vital importance of the temperature condition in the first coking stage of the process according to the present invention for the purpose of efficient removal of non-crystalline substances at the first coking stage.

The same Djatibarang virgin crude oil as that used in Example 1 was preheated in a tube heater under a pressure of 15 kg/cm²G to 480°C and maintained therein at this temperature for 300 seconds to allow the oil to be heat-soaked and then introduced by flashing into a first coking drum. The first coking drum was operated under a pressure of 2 kg/cm²G at various temperature conditions in separate runs. The yield of coke obtained in the first coking drum and the coefficient of thermal expansion, CTE, over 100° – 400°C of the graphite artefact in each run are shown in Table 3.

Table 3

| Run No. | 1 | 2 | 3 | 4 | 5 | 6 | 7 | 8 |
|---|---|---|---|---|---|---|---|---|
| Temperature of the first coking (°C) | 380 | 400 | 410 | 420 | 430 | 440 | 460 | 480 |
| Yield of coke (%) | 0.5 | 2.0 | 5.5 | 6.1 | 6.0 | 8.0 | 10.0 | 11.0 |
| CTE of coke $\times 10^{-6}$/°C | 7 | 7.3 | 7 | 6.7 | 6.6 | 3.8 | 4.1 | 4.8 |

* The cokes of Run Nos. 1 to 5 corresponded to non-crystalline coke defined in Table 1 above and cokes of Run Nos. 6 to 8 were ranked between non-crystalline coke and regular grade coke (for general purposes) defined in Table 1.

The results show that taking both the yield and CTE of the coke obtained in the first coking drum into consideration, a temperature ranging from 410° to 430°C should be used for the efficient and complete removal of non-crystalline substances at this stage.

EXAMPLE 4

Sarir virgin crude oil coming from North Africa having specific gravity (15/4°C) of 0.841, sulfur content of 0.20% and asphaltene content of 6.5% was used in this Example and the procedure used was the same as that used in Example 1 except that the crude oil was preheated in a tube heater under a pressure of 20 kg/cm²G to 500°C and maintained therein at this temperature for 320 seconds to allow the oil to be heat-soaked and that the residence time in the first coking drum was 4.5 hours.

The coke produced in the first coking drum in the yield of 4.0% had $h/w$ of 2.0 and CTE of $4.5 \times 10^{-6}$/°C and the coke produced in the second coking drum in the yield of 9.0% had $h/w$ of 5.2, CTE of $0.81 \times 10^{-6}$/°C (100° – 400°C, directed parallel to the extrusion) and $2.83 \times 10^{-6}$/°C (100° – 400°C, directed parallel to the thickness) and specific resistance of $60 \times 10^{-5}$ Ω-cm.

EXAMPLE 5

In this Example, the same Djatibarang virgin crude oil as that used in Example 1 was used and the procedure used was similar to that used in Example 1 but with the following modifications:

the crude oil was preheated in a tube heater under a pressure of 17 kg/cm²G to 480°C and maintained therein at this temperature for 360 seconds to allow the oil to be heat-soaked;

the first coking drum was operated at 410°C, under 2 kg/cm²G, for 32 hours with a residence time of 4.0 hours;

the feed for the second coking stage was derived from the uncoked product of the first coking stage by distilling the said product under atmospheric pressure to remove cracked gases (5.3%), cracked gasoline fraction (9.3%) and cracked light gas oil fraction (23.7%), distilling bottom residue of said atmospheric distillation under vacuum to remove cracked heavy gas oil fraction (24.2%) and mixing bottom residue of said vacuum distillation with the cracked light gas oil fraction from the atmospheric distillation;

the second coking drum was operated at 440°C, under 9 kg/cm²G for 28 hours.

Surprisingly, the yield and paraffin wax content of the cracked heavy gas oil fraction were significantly increased in comparison with those of a heavy gas oil fraction which was obtained by a conventional atmospheric distillation of the same Djatibarang virgin crude oil and a subsequent conventional vacuum distillation of the atmospheric residue. This will be due to the mild pyrolysis of high-boiling heavy fractions of Djatibarang crude oil occurred in the first coking stage of this invention. Thus, the yield based on crude oil and wax content of the cracked heavy gas oil in this run were 24.2% and 72%, whereas those of the heavy gas oil derived by conventional method as above were 18.4% and 65%, respectively. According to this embodiment, therefore, the yield of paraffin wax amounts to 17.4% based on the crude oil which represents 45% increase as compared with the yield of the same in the conventional method above-mentioned being 12%.

The coke obtained from the first stage in the yield of 5.3% based on the crude oil had $h/w$ of 1.2 and coefficient of thermal expansion (directed parallel to the extrusion, 100°–400°C) of $7.0 \times 10^{-6}$/°C. The coke obtained from the second stage in the yield of 8.6% based on the crude oil had $h/w$ of 5.1, coefficient of thermal expansion (100–400°C) of $0.90 \times 10^{-6}$/°C (directed parallel to the extrusion) and of $3.06 \times 10^{-6}$/°C (directed parallel to the thickness) and specific resistance of $79 \times 10^{-5}$ Ω-cm which showed a very high graphitizability.

EXAMPLE 6

Djatibarang virgin crude oil having specific gravity (15/4°C) of 0.886, sulfur content of 0.17% and asphaltene content of 8.0% was used in this Example and the procedure used was the same as that used in Example 1 except that to the feed for the second coking stage 32% of a thermal tar was incorporated which was prepared by pyrolyzing at 550°C and 50 kg/cm²G cracked gas oil fractions (specific gravity (15/4°C): 0.842) derived from the first and second coking stages and which had specific gravity (15/4°C) of 1.08 and asphaltene content of 12.2%. As a result, the yield of the coke in the second stage was considerably increased.

The coke obtained from the first stage in the yield of 6% based on the crude oil had $h/w$ of 0.8 and coefficient of thermal expansion (100–400°C) of $6.6 \times 10^{-6}$/°C, and the coke obtained from the second stage in the yield of 17.2% had $h/w$ of 5.2, coefficient of thermal expansion (100–400°C) of $0.74 \times 10^{-6}$/°C (directed parallel to the extrusion) and of $2.60 \times 10^{-6}$/°C (directed parallel to the thickness) and specific resistance of $64 \times 10^{-5}$ Ω-cm which showed a very high graphitizability.

EXAMPLE 7

The same Djatibarang virgin crude oil as that used in Example 6 was treated by the process described in Example 1 except that there was used as the feed for the second coking stage a mixture of 80 parts by weight of the bottom residue of the distillation used as such as the second coking feed in Example 1 and 20 parts by weight of a thermal tar which was produced as by-product in the thermal cracking of naphtha for the production of ethylene and which had specific gravity of 1.07 (15/4°C) and asphaltene content of 15.5%.

The coke obtained from the first stage in the yield of 6.0% based on the crude oil had *h/w* of 1.2 and coefficient of thermal expansion (directed parallel to the extrusion, 100°–400°C) of $6.6 \times 10^{-6}$/°C, and the coke obtained from the second stage in the yield of 12% based on the crude oil had *h/w* of 5.0, coefficient of thermal expansion (100°–400°C) of $0.94 \times 10^{-6}$/°C (directed parallel to the extrusion) and of $3.15 \times 10^{-6}$/°C (directed parallel to the thickness) and specific resistance of $68 \times 10^{-5}$ Ω-cm.

What we claim is:

1. A process for the production of high crystalline coke from a virgin crude oil having a sulfur content of lower than 0.4% by weight and substantial amounts of non-crystalline substances which prevent the growth of coke crystals which comprises removing said non-crystalline substances by:

preheating the virgin crude oil in a tube heater to a to a temperature of 460° – 520°C under a pressure of 5 – 20 kg/cm²G;

maintaining the oil in the tube heater at that temperature for 30 – 500 seconds to effect cracking and heat-soaking thereof;

flashing the oil thus heat-treated into a first coking drum, where the oil is subjected to a first delayed coking at a temperature of 410° – 430°C under a pressure of 2–10 kg/cm²G for a residence time of 3 – 5 hours to produce a non-crystalline coke;

removing from the flashed product of the first coking drum cracked gases and light petroleum fractions including gasoline, kerosene and gas oil to provide a heavy residue substantially free of said non-crystalline substances;

preheating said heavy residue of the flashed product to a temperature required for a second coking stage; and introducing the preheated heavy residue into a second coking drum, where it is subjected to a second delayed coking at a temperature of 430° – 460°C under a pressure of 4 – 20 kg/cm²G to produce said high-crystalline coke.

2. A process as claimed in claim 1 wherein the time to maintain the temperature of 460° – 520°C of the preheated virgin crude oil for effecting cracking and heat-soaking thereof is 200 – 500 seconds.

3. A process as claimed in claim 1 wherein the uncoked product of the first coking stage, after the cracked gases and light petroleum fractions have been removed therefrom, is subjected to vacuum distillation to recover a heavy gas oil fraction rich in paraffin wax and thereafter the vacuum residue is subjected to the second delayed coking.

* * * * *